US010850303B2

(12) United States Patent
Linch

(10) Patent No.: US 10,850,303 B2
(45) Date of Patent: Dec. 1, 2020

(54) APPARATUS AND PROCESSES FOR APPLYING A COATING TO ROLL FORMED PRODUCTS

(71) Applicant: Strong-Coat, LLC, Willoughby, OH (US)

(72) Inventor: Stephen C. Linch, Painesville, OH (US)

(73) Assignee: TELLING INDUSTRIES, LLC, Willoughby, OH (US)

( * ) Notice: Subject to any disclaimer, the term of this patent is extended or adjusted under 35 U.S.C. 154(b) by 178 days.

(21) Appl. No.: 16/142,674

(22) Filed: Sep. 26, 2018

(65) Prior Publication Data

US 2019/0022697 A1 Jan. 24, 2019

Related U.S. Application Data

(62) Division of application No. 15/047,304, filed on Feb. 18, 2016, now Pat. No. 10,086,403.

(60) Provisional application No. 62/117,586, filed on Feb. 18, 2015.

(51) Int. Cl.

| | |
|---|---|
| ***B05D 3/00*** | (2006.01) |
| ***B05D 3/02*** | (2006.01) |
| ***B05D 3/06*** | (2006.01) |

(52) U.S. Cl.

CPC ..... *B05D 3/007* (2013.01); *B05D 3/0209* (2013.01); *B05D 3/067* (2013.01); *B05D 2252/02* (2013.01)

(58) Field of Classification Search

USPC ..... 118/620, 621, 641–643, 325, 66, 67; 34/266–269, 275–277

See application file for complete search history.

(56) References Cited

U.S. PATENT DOCUMENTS

| | | | | |
|---|---|---|---|---|
| 3,826,014 A | | 7/1974 | Helding | |
| 4,233,754 A | * | 11/1980 | Dubuit | F26B 3/28 118/642 |
| 2003/0161966 A1 | | 8/2003 | Bible | |
| 2004/0022951 A1 | | 2/2004 | Maurus | |
| 2006/0292311 A1 | | 12/2006 | Kilburn | |
| 2009/0290891 A1 | | 11/2009 | Sievers | |

* cited by examiner

*Primary Examiner* — Yewebdar T Tadesse
(74) *Attorney, Agent, or Firm* — Tucker Ellis LLP

(57) ABSTRACT

A system for processing a product includes a curing chamber, a light source, and a reflective surface. The curing chamber has input and output openings to permit the product carrying a curable material to move therethrough. The curing light source generates a first curing light beam directed from the curing light source to a first portion of the product for curing the curable material carried on the first portion of the product within the curing chamber. The reflective surface directs a second curing light beam from the reflective surface to a second portion of the product for curing the curable material carried on the second portion of the product within the curing chamber. The second portion of the product is inaccessible by the first curing light beam.

9 Claims, 7 Drawing Sheets

APPARATUS AND PROCESSES FOR APPLYING A COATING TO ROLL FORMED PRODUCTS

CROSS REFERENCE TO RELATED APPLICATION

This application is a divisional of U.S. patent application Ser. No. 15/047,304 filed Feb. 18, 2016 which claims the benefit of U.S. Provisional Patent Application No. 62/117,586, filed Feb. 18, 2015, the disclosures of both of which are herein incorporated by reference in their entirety.

FIELD

The embodiments herein are directed to the field of coating roll formed products and more particularly, they relate to apparatus and processes for coating roll formed products that result in completely coated finished products providing complete cut-edge protection by the coating-covering edges that may be formed in the product, and curing the coated edges thereby completely sealing the product in a protective covering or layer of material.

BACKGROUND

Traditionally, roll formed products inherit their coatings from the raw material prior to the roll form manufacturing process. A continuous strip of steel, aluminum, vinyl, or paper is pretreated and pre-coated in a linear process prior to winding the strip into a coil on a mandrel. The final length of pretreated and pre-coated coil is removed from the mandrel to be shipped to a manufacturer that will uncoil the strip in a roll forming process, cutting the coil to length either just prior to the roll forming operation or cutting the roll formed product to length after the roll forming operation. In any regard, the final roll formed product is only coated as a result of its raw material coating prior to the roll forming process. Consequently, any cutting, punching, or piercing of the roll formed product may leave the substrate exposed, particularly along the cut edges.

Conventional pre-coating processes are complex, expensive, and often include the use of volatile organic compounds in both the cleaning of the raw material so contaminants do not interfere with the adhesion of the coating compound to the substrate raw material, but also in the application of the finished coating itself. Large industrial equipment including welders, accumulators and ovens are extremely expensive in terms of capital purchases, but also extremely expensive to operate. Typically, for such a process to be financially viable the user of this equipment must focus his/her business on the process of coating material processes. The cost of the processing adds to the cost of the original raw material substrate to which the coating is applied, consequently the cost is passed on to the manufacturer of the roll formed product, and ultimately, to the manufacturer's consumers.

It can be seen from the above, that the conventional method for coating roll formed products has many deficiencies. First, cut edges of roll formed products resulting from cutting operations during the roll forming process are left exposed, affecting the quality of weatherproofing or corrosion resistance characteristics of the substrate. Second, it requires a large amount of equipment and a building of substantial size to house the equipment and, thus, requires a significant investment of capital. Third, because of the factors and the many pieces of equipment involved in this process, the cost of operation and maintenance is significant. Fourth, the expense of operating the equipment and applying the coatings is passed on to the manufacturer who consumes the coated raw material for the purpose of creating the roll formed products in addition to profit margins from the raw material processor. Fifth, the large cost of coating the raw material limits the variations in coatings to what the supplied industry demands at a given price, while atypical variants in coatings come with a significant price increase applied to the purchaser due to the increased cost of running a "one-off" raw material coil. Lastly, it requires installation of pollution control equipment to minimize pollution to the atmosphere.

SUMMARY

In accordance with an example embodiment, a method of processing an associated product is provided. In the example, an associated product carrying a coating of a curable material or solution is permitted to move through a curing chamber. The associated product carrying the curable material moves through the curing chamber by receiving the associated product into an input opening of the curing chamber and passing the associated product through the curing chamber from the input opening to an exit opening of the curing chamber. The curable material or material carried on a first portion of the associated product is cured within the curing chamber by directing a first curing light beam from a first curing light source to the first portion of the associated product. The curable material or material carried on a second portion of the associated product is cured within the curing chamber by directing a second curing light beam from a first reflective surface to the second portion of the associated product. In the example embodiment, the second portion of the associated product is inaccessible by the first curing light beam. However, the second portion of the associated product is accessible by the second curing light beam since the second curing light beam is directed from the first reflective surface to the second portion of the associated product for curing the curable material or material carried on the second portion of the associated product within the curing chamber. The curable material may be an ultraviolet (UV) light curable coating and the first and second curing light beams may be ultraviolet (UV) light beams, for example.

In accordance with a further example embodiment, a system is provided for processing an associated product. The system includes a curing chamber, a first light source, and a first reflective surface. The curing chamber includes an input opening and an exit opening, and is configured to permit the associated product carrying a curable material to move therethrough by receiving the associated product into the input opening and passing the associated product from the curing chamber to the exit opening. The first curing light source generates a first curing light beam directed from the first curing light source to a first portion of the associated product for curing the curable material carried on the first portion of the associated product within the curing chamber. The first reflective surface directs a second curing light beam from the first reflective surface to the second portion of the associated product for curing the curable material carried on the second portion of the associated product within the curing chamber. In accordance with the example embodiment, the second portion of the associated product is inaccessible by the first curing light beam. However, the second portion of the associated product is accessible by the second curing light beam since the second curing light beam is directed from the first reflective surface to the second portion of the associated product for curing the curable material carried on the second portion of the associated product within the curing chamber.

In accordance with an example method herein, a raw material is roll formed at a roll forming station. The roll formed product is then washed at a washing station, then coated with a curable material, preferable a UV curable material, at a coating station. The roll formed, washed, and coated workpiece is then cured in a curing chamber and, thereafter, cut at a cutting station and made available as a product for delivery to an end customer. It is to be appreciated that the raw material may have been coated prior to the subject roll forming process such as with any of a range of protective coatings including paint or the like.

In accordance with a further example method herein, a raw material is roll formed at a roll forming station, then cut at a cutting station, washed at a washing station, then coated with a curable material, preferable a UV curable material at a coating station. The rolled, cut, washed, and coated workpiece is then cured in a curing chamber and, thereafter, the workpiece is made available as a product for delivery to an end customer. It is to be appreciated that the raw material may have been coated prior to the subject roll forming process such as with any of a range of protective coatings including paint or the like.

In accordance with a still further example method herein, a raw material is washed at a washing station, then coated with a curable material, preferable a UV curable material, at a coating station. The washed and coated workpiece is then cured in a curing chamber and, thereafter, roll formed at a roll forming station then cut as a product for delivery to an end customer. It is to be appreciated that the raw material may have been coated prior to the subject roll forming process such as with any of a range of protective coatings including paint or the like.

In accordance with a yet a further example method herein, a raw material is washed at a washing station, then coated with a curable material, preferable a UV curable material, at a coating station. The washed and coated workpiece is then cured in a curing chamber and, thereafter, cut then roll formed at a roll forming station as a product for delivery to an end customer. It is to be appreciated that the raw material may have been coated prior to the subject roll forming process such as with any of a range of protective coatings including paint or the like.

In accordance with a yet a still further example method herein, a raw material is cut at a cutting station, washed at a washing station, then coated with a curable material, preferable a UV curable material, at a coating station. The cut and coated workpiece is then cured in a curing chamber and, thereafter, roll formed at a roll forming station as a product for delivery to an end customer. It is to be appreciated that the raw material may have been coated prior to the subject roll forming process such as with any of a range of protective coatings including paint or the like.

The roll formed product coating process and system, in accordance with the example embodiments of the invention as claimed herein, provides very significant advantages over the traditional coating method.

In the example embodiment described, the process uses an ultraviolet light curable coating applied by the manufacturer during the roll forming process rather than requiring the manufacturer to purchase raw material from a third party that has been pre-coated for the manufacturer's needs. Consequently, the set-up of a roll former becomes less sensitive to rough dies, and tooling, which can gouge and scratch the pre-coated surface. The example embodiments also eliminate the need for engineering of extensive multi-stage forming for products with rigorous bends to accommodate the continuity of the pre-coated material, as the finished products may be coated in-line after being formed. The need to have a third party process a raw coil is eliminated by the manufacturer who can now coat his or her own coil as necessary, in-line with the manufacturing process. The equipment and processing cost necessary to carry out the roll formed product coating process in accordance with the present invention is far less costly than that required to coat the raw material coil by traditional means. The cost of coating the finished product is thereby greatly reduced.

An additional advantage, in accordance with the example embodiments, is that they provide coating on the entire substrate surface including most or all (per product requirement) cut edges of the finished product. Consequently, this eliminates the need to have the finished products coated after they have been formed (post-coated). Post-coated processing of finished products is not as fast, efficient, or effective when compared to the present invention. The processing for carrying out the coating process in accordance with the example embodiments described herein is faster, more efficient, and less costly than that required to off-line post-coat roll formed products.

Another advantage of the coating process in accordance with the example embodiments is that it allows the manufacturer to coat product on-the-fly on an as needed basis. One coil of raw material purchased at its industry recognized substrate thickness (gauge) can be coated for a few dozen feet with one coating, and then coated with a completely different coating using different compositions to change pigment, elasticity, scratch resistance, or resistance to environmental factors. This allows much greater flexibility in terms of what the manufacturer can offer compared to what must be stocked in raw material inventory reducing warehouse space, as well as cost. The coating chamber, being relatively small, can be quickly and easily cleaned to accept a new coating mixture. Optionally, multiple chambers may be kept on hand for the purpose of a quick change on the roll forming machine requiring no cleaning of the coating chambers.

Finally, another aspect of the example embodiments is that the coating process is environmentally friendly in that it does not result in the emission of pollutants. The term "pollutant" as used in this specification is defined to mean anything characterized by the U.S. Environmental Protection Agency (EPA) as an air pollutant that exceeds limits established by the EPA. The cleaning of the roll formed product to remove contaminants, in accordance with one embodiment of this invention, is accomplished with a water-based, rather than solvent-based, technology, and biodegradable aqueous detergents are available as an additive to the water washing solution. Following the washing of the roll formed product, it is given a clean water rinse and then dried. This cleaning operation does not result in the emission of pollutants. The pretreating of the roll formed product is optionally dependent upon product requirements and product type, and promotes adhesion of the coating to the roll formed product. The application method applied the UV curable coating to the roll formed product and traps free-floating coating particles for recirculation. Finally, curing the coating on the roll formed product is accomplished in-line using ultraviolet light technology, rather than in a pre-coat operation which utilizes an oven which cures the coating by evaporating the liquid in the coating. During the ultraviolet light processing, ultraviolet light photons at a specific wavelength impart energy to electrons in the coating liquid which are redistributed and the coating is transformed into a solid through the process of polymerization and crosslinking. The transformation of the coating into a solid is virtually instantaneous and produces no emissions. Thus, it is seen that the cleaning, coating and curing of the roll formed product does not result in the emission of pollutants that need removed before the emission is released to the atmosphere.

DETAILED DESCRIPTION

Embodiments of the present teachings will be described in greater detail below with references to the Figures. The same features/elements are marked with the same reference numbers in all Figures. For the purpose of clarity, all reference numbers have not been inserted into all Figures. Also, not all views of the components have been shown in separate drawing Figures where the components are the same as or mirror images of components that are shown in one or more separate drawing Figures. In particular, however, for convenience of reference, components that are mirror images of, or mirror image equivalents of, components that are shown in one or more separate drawing Figures will be referred to herein and in the claims to follow using a prime (') suffix notation.

The process of coating a roll formed product made of aluminum, paper, steel, or vinyl may present itself in one of several variations of coating and cutting—with or without in-line punching or piercing—with respect to the forming process.

Figure 1:
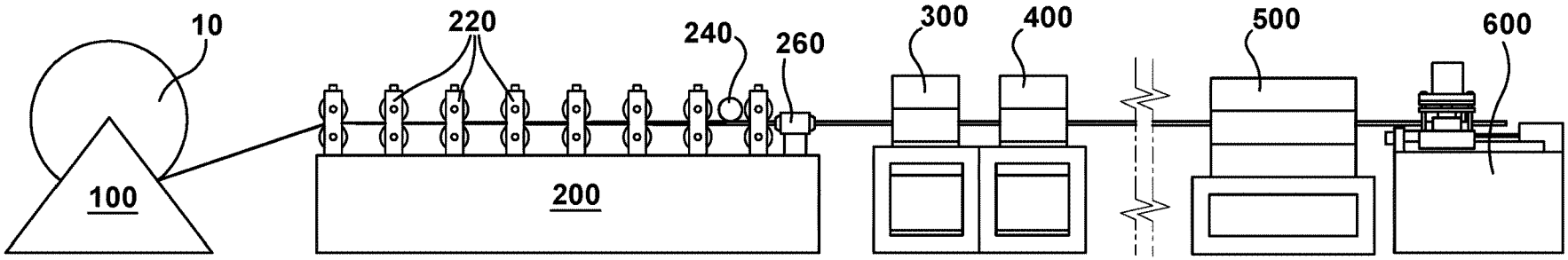
FIG. 1 is an exemplary embodiment of coating roll formed product in accordance with aspects of the present invention.

Referring now to the drawings wherein the showings are for purposes of illustrating the example embodiments only and not for purposes of limiting same and in which like numerals indicate like elements throughout the several views, FIG. 1 illustrates a system and the application of a process in accordance with an example embodiment herein for coating of all surfaces of an associated product in the form of a roll formed product. The system of FIG. 1 is arranged to perform, in succession, roll, wash, coat, cure, and cut operations in accordance with the example embodiment. In accordance with the example method shown, a raw material is roll formed at a roll forming station. The roll formed product is then washed at a washing station, then coated with a curable material, preferable a UV curable material, at a coating station. The roll formed, washed, and coated workpiece is then cured in a curing chamber and, thereafter, cut at a cutting station and made available as a product for delivery to an end customer. It is to be appreciated that the raw material may have been coated prior to the subject roll forming process such as with any of a range of protective coatings including paint or the like.

A coil 10 of raw material is mounted on the rotating mandrel oriented horizontally or vertically of an uncoiler 100. Any raw material that is suitable to be stored as a coil may be used in accordance with aspects of the example embodiment. Exemplary raw materials include but are not limited to: aluminum, paper, steel, vinyl, etc. The uncoiler 100 may be powered or unpowered, with or without a drag brake.

A set of flattening rolls (not shown) may be found in some instances between the uncoiler 100 and the roll former 200. One purpose of flattening rolls is to remove coil set—the natural tendency of a material to hold its shape due to material memory. Flattening rolls may be powered or unpowered, as a sub-assembly of the roll former 200 (not shown) or as a stand-alone floor-mounted unit (not shown). Many roll forming applications do not require flattening rolls.

The leading edge of the coil 10 is fed, preferably by hand, into the first passes of multiple interlocking roll tools 220. The roll tools 220 are mounted to a roll former 200 base, and mechanically driven by an electric motor (not shown) and gear boxes (not shown) transmitting the power of the electric motor via chain-driven sprockets (not shown) or drive shafts (not shown). Once the coil 10 is engaged by the first passes of the roll tooling 220, the roll former 200 automatically pulls the coil 10 through the roll tooling 220 via the friction between the roll tools 220 and the coil 10.

Figure 6:
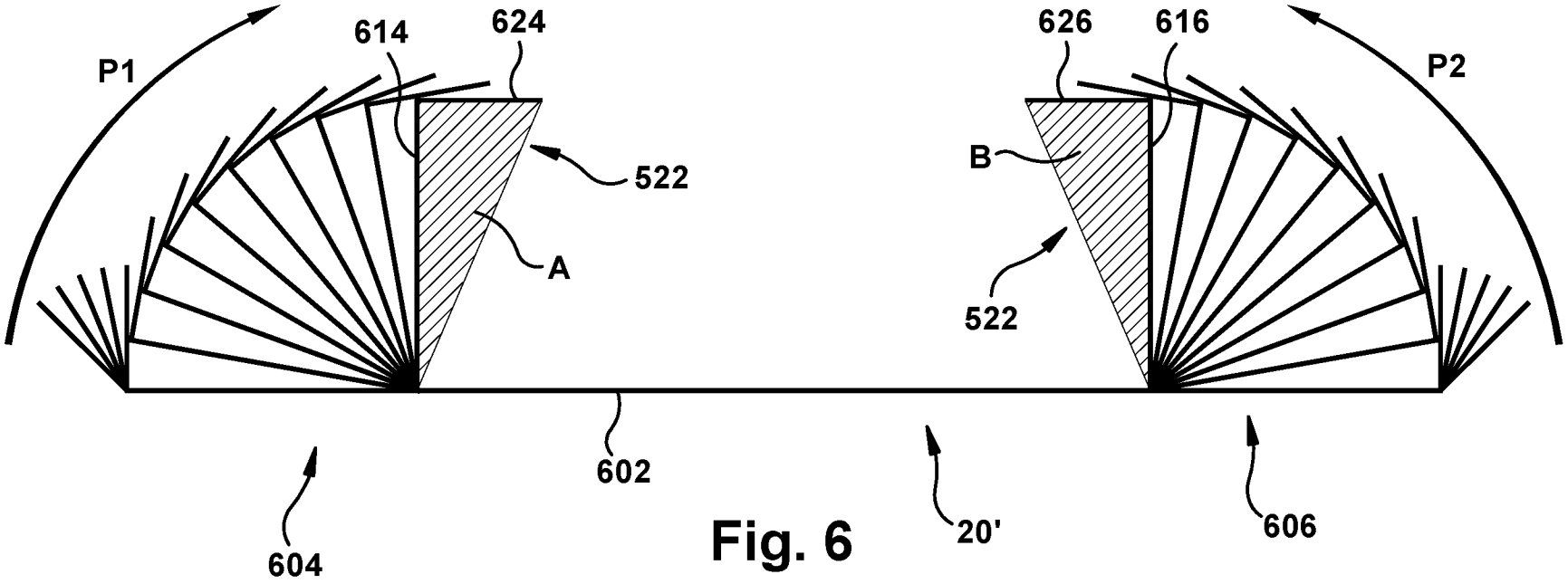
FIG. 6 is an end cross-sectional view of a representative example associated roll formed product coated and cured in accordance with the example embodiments herein.

As the coil 10 flows through the roll tooling 220, each successive pass forms the coil 10 gradually, until it takes the final roll formed shape such as, for example the final roll formed shape shown in cross section in FIG. 6, as it leaves the last roll tooling 220 pass on the roll former 200. At the end of the roll former 200 is a straightening block 260, which can be used to adjust the straightness of the roll formed coil 10 from any deviation caused by the forming process or material inconsistencies. The straightening block may be a solid fixture of steel, wood, plastic, or brass or a set of blocks milled to the formed dimensions of the roll formed product and designed to fit together within a bracket, as a set of straightening rolls mounted within a straightening head, or there may be no straightening apparatus at all, depending on the requirements and raw material properties of the coil 10.

The roll formed coil 10 flows from the straightening block 260 to the wash station 300. In accordance with the example embodiment shown the wash station 300 consists of biodegradable detergent mixed with water and sprayed from nozzles mounted so the spray jet of water and detergent makes physical contact with all surfaces of the roll formed coil 10 in the first chamber, then enters a clean water rinse from spray jets in the second chamber, and finally an air knife to blow water off and dry the roll formed coil 10 as it exits the wash station 300.

A pre-treat station (not shown) may be present as necessary or desired between the wash station 300 and a coating station 400 in some applications. One purpose of the pre-treat solution is to ensure adhesion of the ultraviolet light curable coating solution to the roll formed and washed coil 10. Many ultraviolet light curable coating applications do not require pre-treat solution for the coating solution to adhere to the roll formed and washed coil 10.

From the wash station 300, the roll formed and washed coil 10 flows immediately into the coating station 400. The coating station 400 consists of one of the following: a vacuum coating chamber, a spray chamber, a flow coating chamber, or a roll coating chamber. The roll formed and washed coil 10 is coated in the ultraviolet light curable material inside the coating station 400.

The roll formed, washed, and coated coil 10 exits the coating station 400 and immediately enters the curing chamber 500, where ultraviolet light from high-energy ultraviolet bulbs (FIGS. 7*a*-7*c*) and/or reflectors (optional, shown in FIGS. 7*a*-7*c*) or mirrors (optional, shown in FIGS. 7*a*-7*c*) for re-directing UV light to shadow areas of the part otherwise inaccessible by direct illumination, cures the coating solution within a desired timeframe (e.g., less than a few seconds and in a preferred embodiment in approximately 0.5 seconds). Ultraviolet bulbs are mounted above, below, and to the sides of the pass height of the roll formed, washed, and coated coil 10, so that the entire surface of the roll formed, washed, and coated coil 10 may be exposed to ultraviolet light.

On the roll former 200, the roll formed coil 10 flows under a rotary encoder 240 for the purpose of length measurement. The encoder 240 sends length data to a computerized control system (not shown) that tracks the roll formed coil 10 in order to perform any required punching or piercing operations (punching/piercing equipment not shown), as well as cuts it to length. As the roll formed, washed, coated, and cured coil 10 exits the curing chamber 500, it flows through the cutoff press 600 and is cut to length into finished roll formed products for stacking and packaging.

Figure 2:
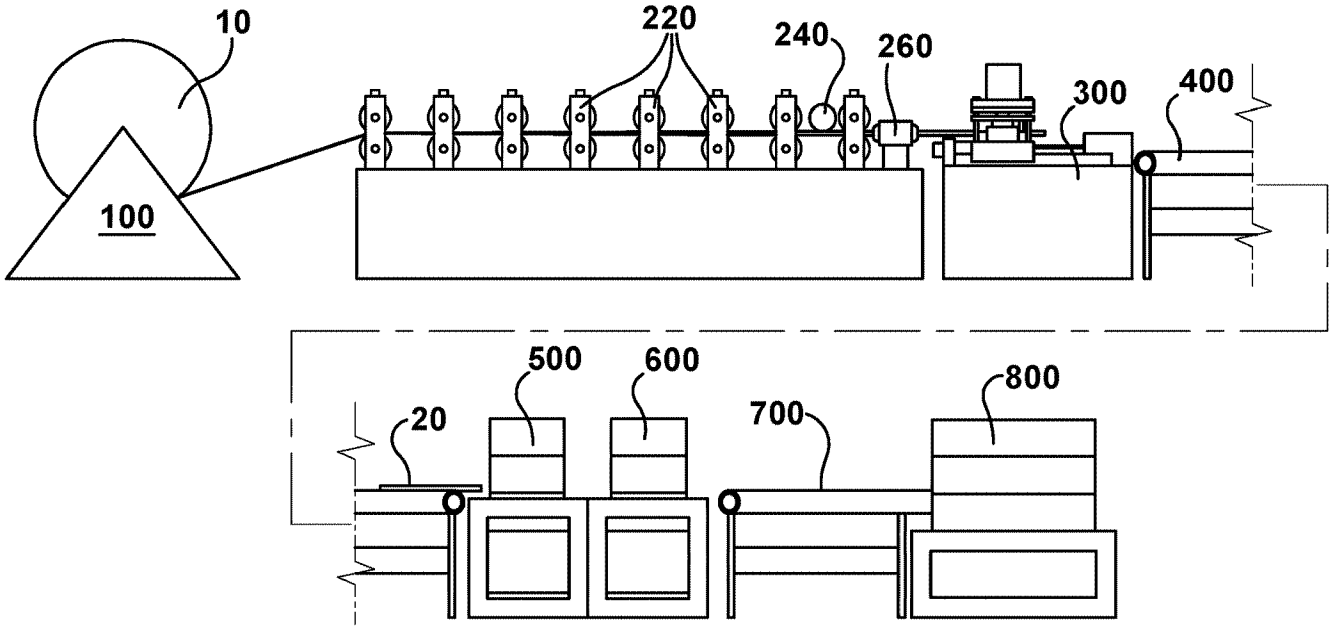
FIG. 2 is another exemplary embodiment of coating roll formed product in accordance with aspects of the present invention.

Referring next to FIG. 2 a further exemplary application for coating of all surfaces of a roll formed product in accordance with a further aspect of the embodiments herein is illustrated. The system of FIG. 2 is arranged to perform, in succession, roll, cut, wash, coat, and cure operations in accordance with the example embodiment. In accordance with the example method shown, a raw material is roll formed at a roll forming station, then cut at a cutting station, washed at a washing station, then coated with a curable material, preferable a UV curable material at a coating station. The rolled, cut, washed, and coated workpiece is then cured in a curing chamber and, thereafter, the workpiece is made available as a product for delivery to an end customer.

A coil 10 of raw material is mounted on the rotating mandrel oriented horizontally or vertically of an uncoiler 100. The uncoiler 100 may be powered or unpowered, with or without a drag brake. A set of flattening rolls (not shown) may be found in some instances between the uncoiler 100 and the roll former 200. One purpose of flattening rolls is to remove coil set—the natural tendency of a material to hold its shape due to material memory. Flattening rolls may be powered or unpowered, as a sub-assembly of the roll former 200 (not shown) or as a stand-alone floor-mounted unit (not shown). Many roll forming applications do not require flattening rolls.

The leading edge of the coil 10 is hand fed into the first passes of multiple interlocking roll tools 220. The roll tools 220 are mounted to a roll former 200 base, and mechanically driven by an electric motor (not shown) and gear boxes (not shown) transmitting the power of the electric motor via chain-driven sprockets (not shown) or drive shafts (not shown). Once the coil 10 is engaged by the first passes of the roll tooling 220, the roll former 200 automatically pulls the coil 10 through the roll tooling 220 via the friction between the roll tooling 220 and the coil 10.

As the coil 10 flows through the roll tooling 220, each successive pass of roll tool 220 forms the coil 10 gradually, until it takes the final roll formed shape as it leaves the last pass on the roll former 200. At the end of the roll former 200 is a straightening block 260, which can be used to adjust the straightness of the roll formed coil 10 from any deviation caused by the forming process or material inconsistencies. The straightening block may be a solid fixture of steel, wood, plastic, or brass or a set of blocks milled to the formed dimensions of the product and designed to fit together within a bracket, as a set of straightening rolls mounted within a straightening head, or there may be no straightening apparatus at all, depending on the requirements and raw material properties of the coil 10.

The roll formed coil 10 flows from the straightening block 260 to the cutoff press 300. On the roll former 200, the roll formed coil 10 flows under a rotary encoder 240 for the purpose of length measurement. The encoder 240 sends length data to a computerized control system (not shown) that tracks the roll formed coil 10 in order to perform any required punching or piercing operations (punching/piercing equipment not shown), as well as cuts it to length. As the roll formed coil 10 exits the straightening block 260, it flows through the cutoff press 300 and is cut to length on-the-fly.

Cut from the roll formed coil 10, the roll formed product 20 falls onto the first carryover conveyor 400. The first carryover conveyor 400 transfers the roll formed product 20 to the wash station 500.

The wash station 500 consists of biodegradable detergent mixed with water and sprayed from nozzles mounted so the spray jet of water and detergent makes physical contact with all surfaces of the roll formed product 20 in the first chamber, then enters a clean water rinse from spray jets in the second chamber, and finally an air knife to blow water off and dry the roll formed product 20 as it exits the wash station 500.

A pre-treat station (not shown) may be present as necessary or desired between the wash station 500 and the coating station 600 in some applications. One purpose of the pre-treat solution is to ensure adhesion of the ultraviolet light curable coating solution to the roll formed product 20. Many ultraviolet light curable coating applications do not require pre-treat solution for the coating solution to adhere to the roll formed product 20.

From the wash station 500, the washed roll formed product 20 flows immediately into the coating station 600. The coating station 600 consists of one of the following: a vacuum coating chamber, a spray chamber, a flow coating chamber, or a roll coating chamber. The washed and roll formed product 20 is coated in the ultraviolet light curable material inside the coating station 600. Depending on the minimum length, roll formed shape, and material characteristics of the washed roll formed product 20, additional guides and powered or unpowered rollers might be required to ensure consistent flow of the individually cut roll formed products 20 through the wash station 500 and the coating station 600. Each roll formed product 20 is preferably examined for the characteristics of minimum length, roll formed shape, and material characteristics to determine the extent to which additional guides and rollers will be required, and to determine where those guides and rollers must be placed to ensure continuous and consistent flow through the wash station 500 and the coating station 600. These determinations must be taken on a case-by-case basis.

The washed and coated roll formed product 20 exits the coating station 600 and is picked up by the second carryover conveyor 700. The carryover conveyor 700 transfers washed and coated roll formed products 20 to the curing chamber 800, where ultraviolet light from high-energy ultraviolet bulbs (not shown) and/or reflectors (optional, shown in FIGS. 7*a*-7*c*) or mirrors (optional, shown in FIGS. 7*a*-7*c*) for re-directing UV light to shadow areas of the part otherwise inaccessible by direct illumination, cures the coating solution in approximately 0.5 seconds or any desired time as described above. Ultraviolet bulbs are mounted above, below, and to the sides of the pass height of the washed and coated roll formed product 20, so that the entire surface of the washed and coated roll formed product 20 may be exposed to ultraviolet light. Depending on the minimum length, roll formed shape, and material characteristics of the roll formed product 20, additional guides and powered or unpowered rollers might be required to ensure consistent flow of the individually cut, roll formed products 20 through the curing chamber 800. Each roll formed product 20 is preferably examined for the characteristics of minimum length, roll formed shape, and material characteristics to determine the extent to which additional guides and rollers will be required, and to determine where those guides and rollers must be placed to ensure continuous and consistent flow through the curing chamber 800. These determinations must be taken on a case-by-case basis. Additional carryover conveyors (not shown) will transfer the washed and coated roll formed product 20 through the curing chamber 800 until the fully cured and finished roll formed product 20 exits the curing chamber 800 for stacking and packaging.

Figure 3:
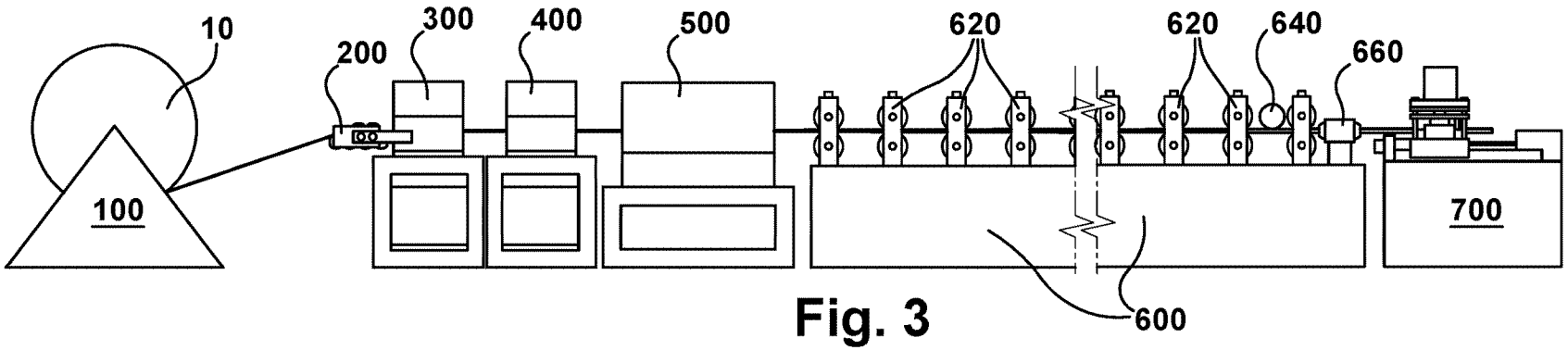
FIG. 3 is another exemplary embodiment of coating roll formed product in accordance with aspects of the present invention.

Referring next to FIG. 3, a further exemplary application for coating of all surfaces of a roll formed product in accordance with a further aspect of the embodiments herein is illustrated. The system of FIG. 3 is arranged to perform, in succession, wash, coat, cure, roll, and cut operations in accordance with the example embodiment. In accordance with the example method shown, a raw material is washed at a washing station, then coated with a curable material, preferable a UV curable material, at a coating station. The washed and coated workpiece is then cured in a curing chamber and, thereafter, roll formed at a roll forming station then cut as a product for delivery to an end customer.

A coil 10 of raw material is mounted on the rotating mandrel oriented horizontally or vertically of an uncoiler 100. The uncoiler 100 may be powered or unpowered, with or without a drag brake. The leading edge of the coil 10 is hand fed a set of flatting rolls 200, through the wash station 300, through the coating station 400, and into the first passes of multiple interlocking roll tools 620. The roll tools 620 are mounted to a roll former 600 base, and mechanically driven by an electric motor (not shown) and gear boxes (not shown) transmitting the power of the electric motor via chain-driven sprockets (not shown) or drive shafts (not shown). Once the coil 10 is engaged by the first passes of the roll tooling 620, the roll former 600 automatically pulls the coil 10 through the roll tooling 620 via the friction between the roll tools 620 and the coil 10.

Once the coil 10 can be drawn automatically off the uncoiler 100 and the intermediate process sections, the coil 10 is drawn through a set of flattening rolls 200 to remove coil set—the natural tendency of a material to hold its shape due to material memory. Flattening rolls may be powered or unpowered.

The coil 10 flows from the flatting rolls 200 to the wash station 300. The wash station 300 consists of biodegradable detergent mixed with water and sprayed from nozzles mounted so the spray jet of water and detergent makes physical contact with all surfaces of the coil 10 in the first chamber, then enters a clean water rinse from spray jets in the second chamber, and finally an air knife to blow water off and dry the coil 10 as it exits the wash station 300.

A pre-treat station (not shown) may be present as necessary or desired between the wash station 300 and the coating station 400 in some applications. One purpose of the pre-treat solution is to ensure adhesion of the ultraviolet light curable coating solution to the washed coil 10. Many ultraviolet light curable coating applications do not require pre-treat solution for the coating solution to adhere to the washed coil 10.

From the wash station 300, the washed coil 10 flows immediately into the coating station 400. The coating station 400 consists of one of the following: a vacuum coating chamber, a spray chamber, a flow coating chamber, or a roll coating chamber. The washed coil 10 is coated in the ultraviolet light curable material inside the coating station 400.

The washed and coated coil 10 exits the coating station 400 and immediately enters the curing chamber 500, where ultraviolet light from high-energy ultraviolet bulbs (FIGS. 7*a*-7*c*) and/or reflectors (optional, shown in FIGS. 7*a*-7*c*) or mirrors (optional, shown in FIGS. 7*a*-7*c*) for re-directing UV light to shadow areas of the part otherwise inaccessible by direct illumination, cures the coating solution in approximately 0.5 seconds or as otherwise disclosed herein. Ultraviolet bulbs are mounted above, below, and to the sides of the pass height of the washed and coated coil 10, so that the entire surface of the washed and coated coil 10 may be exposed to ultraviolet light.

The washed, coated and cured coil 10 exits the curing chamber 500 and immediately flows into the roll tools 620 of the roll former 600. As the washed, coated and cured coil 10 flows through the roll tools 620, each successive pass forms the washed, coated and cured coil 10 gradually, until it takes the final roll formed shape as it leaves the last pass on the roll former 600. At the end of the roll former 600 is a straightening block 660 that can be used to adjust the straightness of the washed, coated, cured and roll formed coil 10 from any deviation caused by the forming process or material inconsistencies. The straightening block may be a solid fixture of steel, wood, plastic, or brass or a set of blocks milled to the formed dimensions of the product and designed to fit together within a bracket, as a set of straightening rolls mounted within a straightening head, or there may be no straightening apparatus at all, depending on the requirements and raw material properties of the coil 10.

On the roll former 600, the washed, coated, cured and roll formed coil 10 flows under a rotary encoder 640 for the purpose of length measurement. The encoder 640 sends length data to a computerized control system (not shown) that tracks the washed, coated, cured and roll formed coil 10 in order to perform any required punching or piercing operations (punching/piercing equipment not shown), as well as cuts it to length. As the washed, coated, cured and roll formed coil 10 exits the roll former 600, it flows through the cutoff press 700 and is cut to length into finished roll formed products for stacking and packaging.

Figure 4:
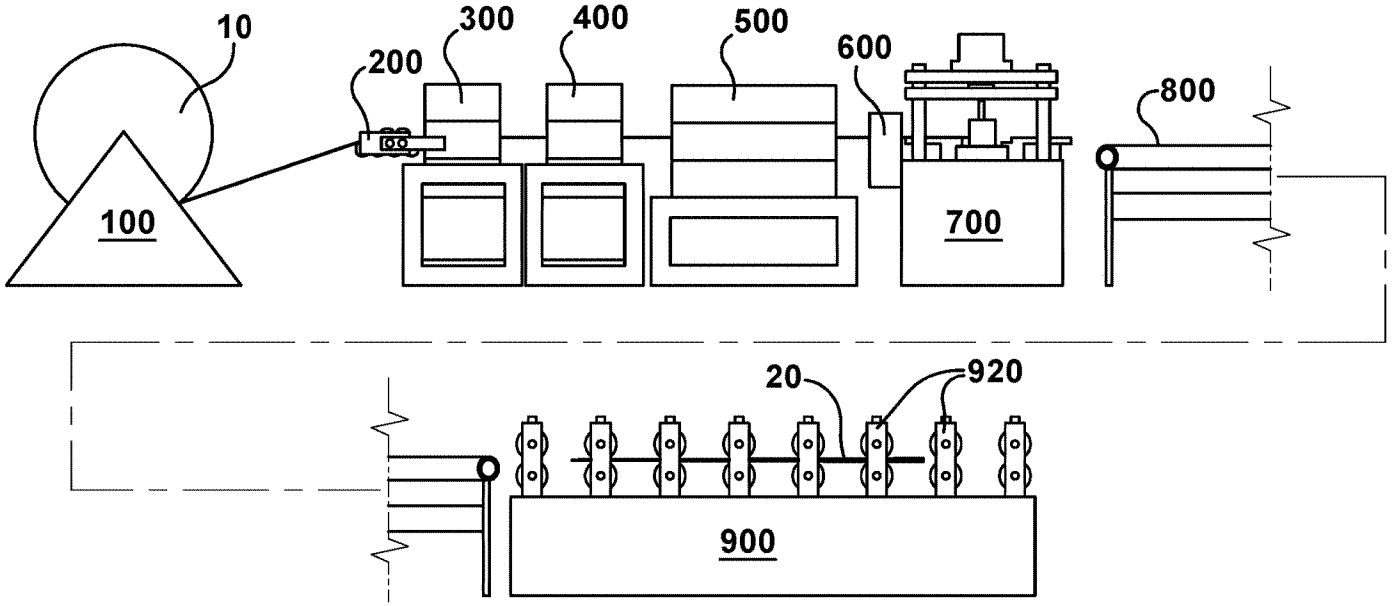
FIG. 4 is another exemplary embodiment of coating roll formed product in accordance with aspects of the present invention.

Referring next to FIG. 4, a further exemplary application for coating of all surfaces of a roll formed product in accordance with a further aspect of the embodiments herein is illustrated. The system of FIG. 4 is arranged to perform, in succession, wash, coat, cure, cut, and roll operations in accordance with the example embodiment. In accordance with the example method shown, a raw material is washed at a washing station, then coated with a curable material, preferable a UV curable material, at a coating station. The washed and coated workpiece is then cured in a curing chamber and, thereafter, cut then roll formed at a roll forming station as a product for delivery to an end customer.

A coil 10 of raw material is mounted on the rotating mandrel oriented horizontally or vertically of an uncoiler 100. The uncoiler 100 may be powered or unpowered, with or without a drag brake. The leading edge of the coil 10 is hand fed through a set of flatting rolls 200, through the wash station 300, through the coating station 400, through the curing chamber 500, and into a set of powered feed rolls 600. Once the coil 10 can be drawn automatically off the uncoiler 100 and the intermediate process sections, the coil 10 is drawn through a set of flattening rolls 200 to remove coil set—the natural tendency of a material to hold its shape due to material memory. Flattening rolls may be powered or unpowered.

The coil 10 flows from the flatting rolls 200 to the wash station 300. The wash station 300 consists of biodegradable detergent mixed with water and sprayed from nozzles mounted so the spray jet of water and detergent makes physical contact with all surfaces of the coil 10 in the first chamber, then enters a clean water rinse from spray jets in the second chamber, and finally an air knife to blow water off and dry the coil 10 as it exits the wash station 300.

A pre-treat station (not shown) may be present as necessary or desired between the wash station 300 and the coating station 400 in some applications. One purpose of the pre-treat solution is to ensure adhesion of the ultraviolet light curable coating solution to the washed coil 10. Many ultraviolet light curable coating applications do not require pre-treat solution for the coating solution to adhere to the washed coil 10.

From the wash station 300, the washed coil 10 flows immediately into the coating station 400. The coating station 400 consists of one of the following: a vacuum coating chamber, a spray chamber, a flow coating chamber, or a roll coating chamber. The washed coil 10 is coated in the ultraviolet light curable material inside the coating station 400.

The washed and coated coil 10 exits the coating station 400 and immediately enters the curing chamber 500, where ultraviolet light from high-energy ultraviolet bulbs (FIGS. 7*a*-7*c*) and/or reflectors (optional, shown in FIGS. 7*a*-7*c*) or mirrors (optional, shown in FIGS. 7*a*-7*c*) for re-directing UV light to shadow areas of the part otherwise inaccessible by direct illumination, cures the coating solution in approximately 0.5 seconds. Ultraviolet bulbs are mounted above, below, and to the sides of the pass height of the washed and coated coil 10, so that the entire surface of the washed and coated coil 10 may be exposed to ultraviolet light.

The washed, coated and cured coil 10 exits the curing chamber and immediately flows into the powered feed rolls 600. The feed rolls 600 drive the washed, coated and cured coil 10 through the cutoff press 700. The feed rolls 600 are controlled by a computerized length control system (not shown). The washed, coated and cured coil 10 is fed to a specific length, measured either by a rotary encoder (not shown) mounted to the motor that drives the feed rolls 600, or by a separate rotary encoder (not shown) mounted to contact the material, directly. In either case, the encoder transmits length data to a computerized control system in order to perform any required punching or piercing operations (punching/piercing equipment not shown), as well as cuts the washed, coated and cured coil 10 to length. Once the appropriate length of washed, coated and cured coil 10 has been measured, the cutoff press 700 cuts the washed, coated and cured coil 10 into a flat sheet 20.

Flat sheets 20 fall onto a carryover conveyor 800 to be transferred down to roll tools 920. The roll tools 920 are mounted to a roll former 900 base, and mechanically driven by an electric motor (not shown) and gear boxes (not shown) transmitting the power of the electric motor via chain-driven sprockets (not shown) or drive shafts (not shown). Once the flat sheet 20 is engaged by the first passes of the roll tooling 920, the roll former 900 automatically pulls the flat sheet 20 through the roll tooling 920 via the friction between the roll tools 920 and the flat sheet 20.

As a flat sheet 20 flows through the roll tools 920, each successive pass of the roll tools 920 forms the flat sheet 20 gradually, until the flat sheet takes the final roll formed shape as it leaves the last roll tool pass 920 on the roll former 900. At this point, the flat sheet 20 has been changed into a finished roll formed product which exits the roll former 900 for stacking and packaging.

Figure 5:
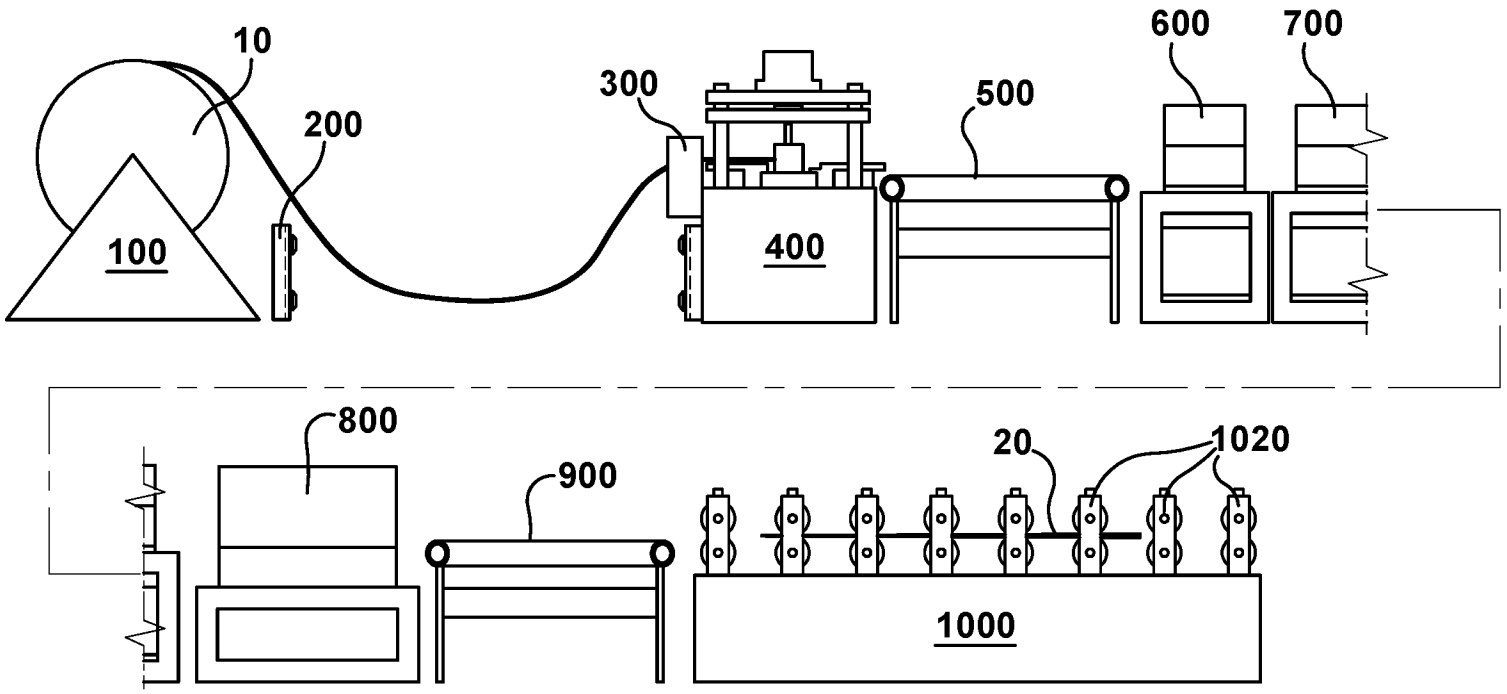
FIG. 5 is another exemplary embodiment of coating roll formed product in accordance with aspects of the present invention.

Referring next to FIG. 5, a further exemplary application for coating of all surfaces of a roll formed product in accordance with a further aspect of the embodiments herein is illustrated. The system of FIG. 5 is arranged to perform, in succession, cut, wash, coat, cure, and roll operations in accordance with the example embodiment. In accordance with the example method shown, a raw material is cut at a cutting station, washed at a washing station, then coated with a curable material, preferable a UV curable material, at a coating station. The cut and coated workpiece is then cured in a curing chamber and, thereafter, roll formed at a roll forming station as a product for delivery to an end customer.

A coil 10 of raw material is mounted on the rotating mandrel oriented horizontally or vertically of an uncoiler 100. The uncoiler 100 may be powered or unpowered, with or without a drag brake. A set of flattening rolls (not shown) may be found in some instances between the uncoiler 100 and the feed rolls 300. One purpose of flattening rolls is to remove coil set—the natural tendency of a material to hold its shape due to material memory. Flattening rolls may be powered or unpowered, as a sub-assembly of the feed rolls 300 (not shown) or as a stand-alone floor-mounted unit (not shown). Many roll forming applications do not require flattening rolls.

The leading edge of the coil 10 is hand fed through a set of powered feed rolls 300. Once the coil 10 can be drawn automatically off the uncoiler 100, the feed rolls pull the material from a loop created between the uncoiler 100 and the feed rolls 300. The loop is maintained by a loop control mechanism—an ultra-sonic sensor, photo-eyes (illustrated) 200, or dancer arm assembly. The loop between the uncoiler 100 and feed rolls 300 is necessary due to differences in the inertia of the uncoiler and its ability to keep up with the feed rolls 300.

The feed rolls 300 drive the coil 10 through the cutoff press 400. The feed rolls 300 are controlled by a computerized length control system (not shown). The coil 10 is fed to a specific length, measured either by a rotary encoder (not shown) mounted to the motor that drives the feed rolls 300, or by a separate rotary encoder (not shown) mounted to contact the material, directly. In either case, the encoder transmits length data to a computerized control system in order to perform any required punching or piercing operations (punching/piercing equipment not shown), as well as cuts the washed, coated and cured coil 10 to length. Once the appropriate length of coil 10 has been measured, the cutoff press 400 cuts the coil 10 into a flat sheet 20.

Flat sheets 20 fall onto a carryover conveyor 500 to be transferred the wash station 600. The wash station 600 consists of biodegradable detergent mixed with water and sprayed from nozzles mounted so the spray jet of water and detergent makes physical contact with all surfaces of the flat sheet 20 in the first chamber, then enters a clean water rinse from spray jets in the second chamber, and finally an air knife to blow water off and dry the flat sheet 20 as it exits the wash station 600.

A pre-treat station (not shown) may be present as necessary or desired between the wash station 600 and the coating station 700 in some applications. One purpose of the pre-treat solution is to ensure adhesion of the ultraviolet light curable coating solution to the washed flat sheet 20. Many ultraviolet light curable coating applications do not require pre-treat solution for the coating solution to adhere to the washed flat sheet 20.

From the wash station 600, the washed flat sheet 20 flows immediately into the coating station 700. The coating station 700 consists of one of the following: a vacuum coating chamber, a spray chamber, a flow coating chamber, or a roll coating chamber. The washed flat sheet 20 is coated in the ultraviolet light curable material inside the coating station 700.

The washed and coated flat sheet 20 exits the coating station 700 and immediately enters the curing chamber 800, where ultraviolet light from high-energy ultraviolet bulbs (FIGS. 7*a*-7*c*) and/or reflectors (optional, shown in FIGS. 7*a*-7*c*) or mirrors (optional, shown in FIGS. 7*a*-7*c*) for re-directing UV light to shadow areas of the part otherwise inaccessible by direct illumination, cures the coating solution in approximately 0.5 seconds or as otherwise described herein. Ultraviolet bulbs are mounted above, below, and to the sides of the pass height of the washed and coated flat sheet 20, so that the entire surface of the washed and coated flat sheet 20 may be exposed to ultraviolet light. Depending on the minimum length and material characteristics of the flat sheet 20, additional guides and powered or unpowered rollers might be required to ensure consistent flow of the individually cut flat sheets 20 through the wash station 600, the coating station 700, and the curing chamber 800. Each flat sheet material type 20 is preferably examined for the characteristics of minimum length and material characteristics to determine the extent to which additional guides and rollers will be required, and to determine where those guides and rollers must be placed to ensure continuous and consistent flow through the wash station 600, the coating station 700 and the curing chamber 800. These determinations must be taken on a case-by-case basis.

Washed, coated and cured flat sheets 20 exit the curing chamber 800 and are taken by the carryover conveyor 900 to be transferred down to roll tools 1020. The roll tools 1020 are mounted to a roll former 1000 base, and mechanically driven by an electric motor (not shown) and gear boxes (not shown) transmitting the power of the electric motor via chain-driven sprockets (not shown) or drive shafts (not shown). Once the washed, coated and cured flat sheet 20 is engaged by the first passes of the roll tooling 1020, the roll former 1000 automatically pulls the washed, coated and cured flat sheet 20 through the roll tooling 1020 via the friction between the roll tools 1020 and the washed, coated and cured flat sheet 20.

As a washed, coated and cured flat sheet 20 flows through the roll tools 1020, each successive pass of the roll tools 1020 forms the washed, coated and cured flat sheet 20 gradually, until the washed, coated and cured flat sheet takes the final roll formed shape as it leaves the last roll tool pass 1020 on the roll former 1000. At this point, the washed, coated and cured flat sheet 20 has been changed into a finished roll formed product which exits the roll former 1000 for stacking and packaging.

FIG. 6 is an end cross-sectional view of a representative example associated roll formed product 20' to be coated and cured in accordance with the example embodiments herein. As shown, the associated product 20' has a generally "C" shape which by its inherent shape generates one or more shadow areas A, B underneath the return where a reflector, or mirror may be selectively positioned (FIGS. 7*a*-7*c*) to re-direct the UV curing light towards the one or more shadow areas A, B thereby exposing the material to ultraviolet light for curing the material there. The positioning of the reflector or mirror is, in accordance with the example embodiment, adjustable as will be described below in connection with the discussion of FIGS. 7*a*-7*c*, and the positioning and quantity of reflectors is determined on a case-by-case basis in accordance with the roll formed profile of the associated part or product, to ensure exposure of the material to ultraviolet light in the shadowed area of the roll formed profile to cure the ultraviolet curable coating solution.

The associated roll formed product 20' in the example embodiment has, as noted, a generally "C" shape formed by a central web portion 602 having on opposite sides thereof bent regions 604, 606 wherein the bent regions are worked in the roll processes described above. The left bent region 604 includes a flange portion 614 carrying on an end thereof a return member 624. Similarly, the right bent region 606 includes a flange portion 616 carrying on an end thereof a return member 626. The flange portion 614 and the return member 624 of the left bent region 604 is formed as the flat sheet 20 flows through the successive rolls 920 as described above and is formed generally in the direction marked P1 in the drawing. Similarly, the flange portion 616 and the return member 626 of the right bent region 606 is formed as the flat sheet 20 flows through the successive rolls 920 as described above and is formed generally in the direction marked P2 in the drawing.

Figure 7A:
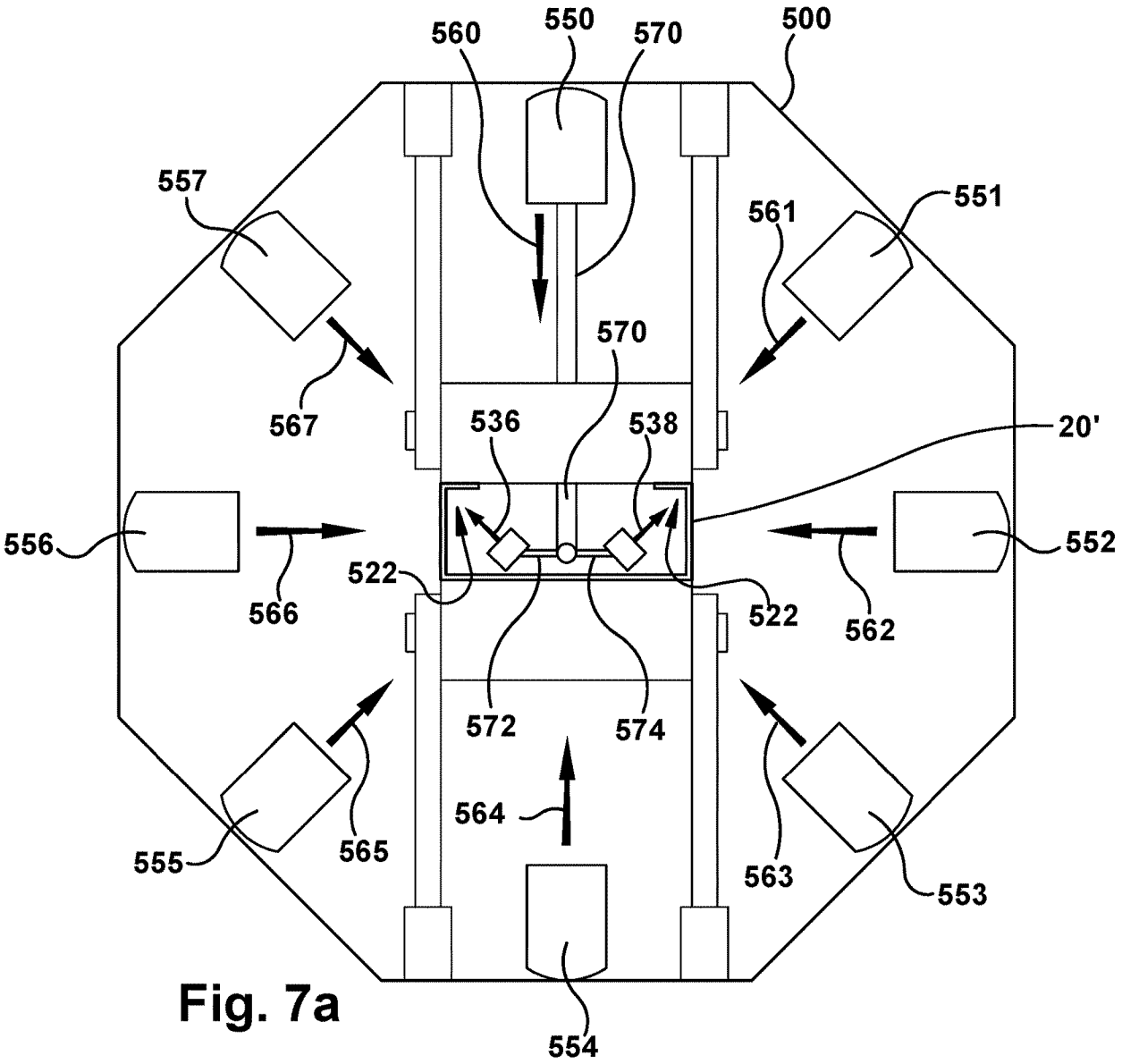
FIG. 7*a* is an end view in partial cross-section of a curing station in accordance with an example embodiment herein.
Figure 7B:
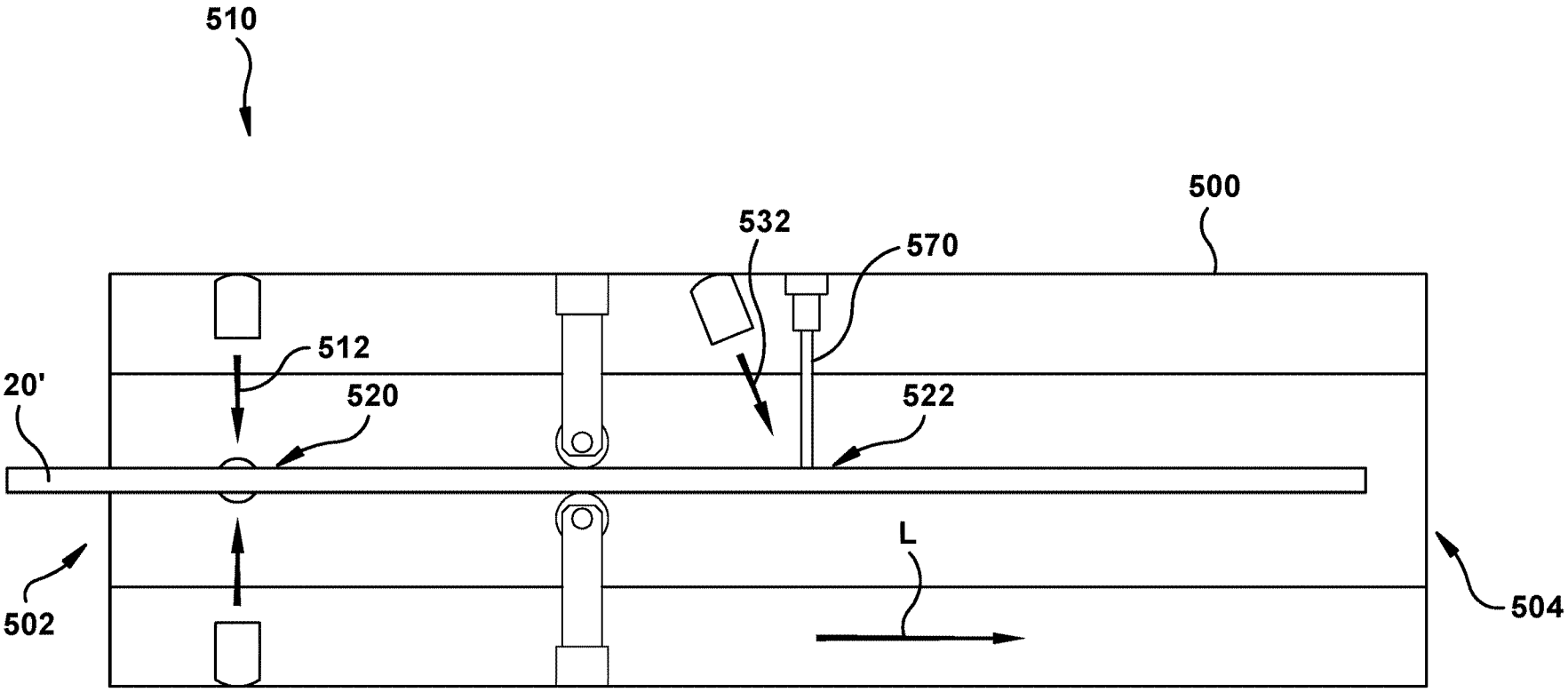
FIG. 7*b* is a side view in partial cross-section of a curing station in accordance with an example embodiment herein.
Figure 7C:
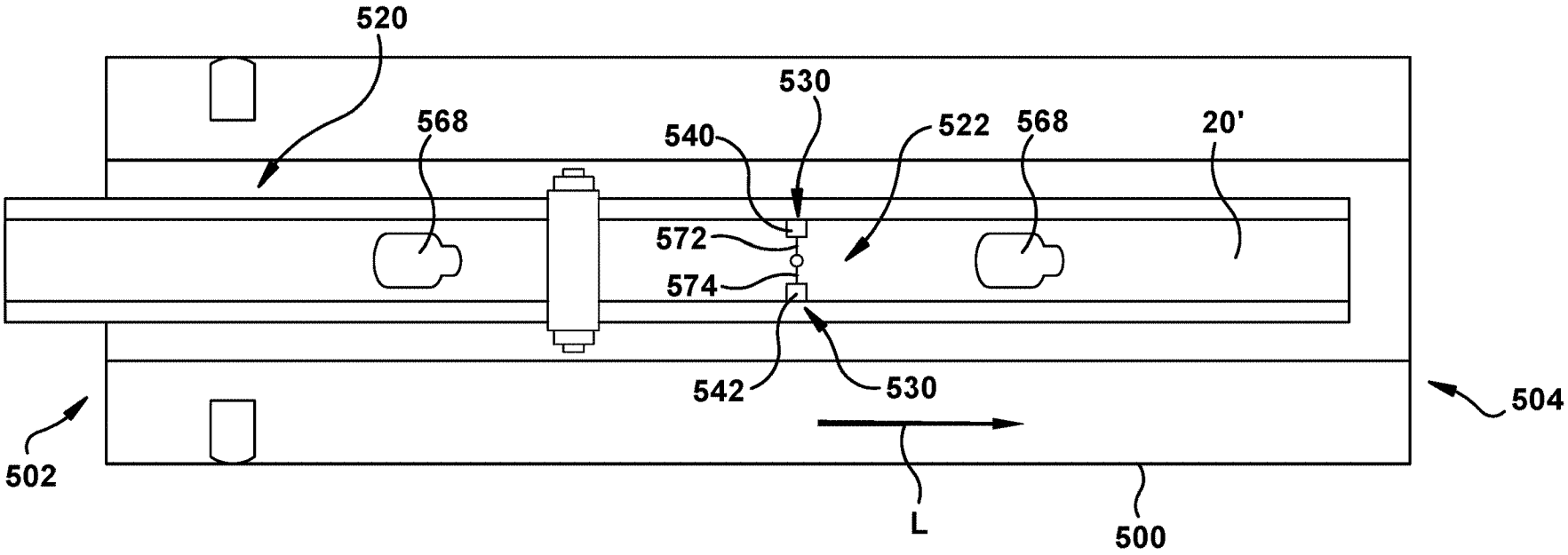
FIG. 7*c* is a top view in partial cross-section of a curing station in accordance with an example embodiment herein.

FIGS. 7*a*-7*c* are end, side, and top views in partial cross-section of a curing station 500 in accordance with an example embodiment herein. These Figures illustrate a further object of the embodiments herein that the roll formed part enters a curing chamber as best described in illustration FIGS. 1-5. The curing chamber may be shaped in multiple configurations in accordance with the roll formed profile. Additionally, the curing chamber may have different ultraviolet bulb and lamp configurations and/or arrangements in accordance with the particular size, shape, and other characteristics of the associate roll formed profile product being processed by the system 1.

In addition, the FIGS. 7*a*-7*c* illustrate a further object of the embodiments herein to provide a process whereby the ultraviolet coated material is contacted by powered or unpowered rollers as described in the illustrations. The powered or unpowered rollers as described contact the ultraviolet coated material inside the curing chamber after the roll formed part has been cured at the point of contact. The powered or unpowered rollers located inside the curing chamber as described provide support to the roll formed part as it passes through the remaining curing process which may include reflectors, or mirrors positioned to cure the shadowed area of the profile illustrated in FIG. 6.

Yet still further, FIGS. 7*a*-7*c* illustrate a further object of the embodiments herein to that the roll formed shape may contain punch outs 568 best characterized in the descriptions of illustrations FIGS. 2, and 5. These punch outs have cut edges as illustrated in FIG. 7*c* and are coated and cured during the coating and curing steps thereof creating complete cut edge protection of the roll formed profile.

Overall, therefore, FIGS. 7*a*-7*c* illustrate a further object of the embodiments herein to that an entirety of a final roll formed shape containing shadows as it passes through the roll former and ultraviolet light source is exposed to ultraviolet light for curing all of the curable coating, including portions of the curable coating that may be disposed on the associated product in the shadow areas A, B. Figures s 7*a*-7*c* illustrate an object of a curing chamber which contains one or more first ultraviolet bulbs located at one or more first locations within the curing chamber, and one or more reflectors mounted in one or more strategic locations within the curing chamber to reflect UV light into areas on the associated roll formed product that are otherwise inaccessible by direct light, to cure the ultraviolet curable coating solution in those areas.

In accordance with the example embodiment, a system 1 is provided for processing an associated product 20, 20'. The system 1 of the example embodiment includes a curing chamber 500, a first curing light source 510, and a first reflective surface 530. The curing chamber 500 includes an input opening 502 and an exit opening 504. The curing chamber 500 is configured to permit the associated product 20, 20' carrying a curable material to move therethrough by receiving the associated product into the input opening 502 and passing the associated product from the curing chamber to the exit opening 504.

The first curing light source 510 generates a first curing light beam 512 directed from the first curing light source 510 to a first portion 520 of the associated product for curing the curable material carried on the first portion 520 of the associated product within the curing chamber. Somewhat similarly, the first reflective surface 530 directs a second curing light beam 532 from the first reflective surface 530 to a second portion 522 (FIGS. 6, 7*a*) of the associated product for curing the curable material carried on the second portion 522 of the associated product within the curing chamber. In the example embodiment illustrated, the second portion 522 of the associated product 20, 20' is inaccessible by the first curing light beam 512.

In further accordance with the example embodiment, the first reflective surface 530 comprises a plurality of mirrors or other reflectors 540, 542 receiving a composite second curing light beam 534 and reflecting the composite second curing light beam from the plurality of mirrors or other reflectors 540, 542 as a plurality of second curing light beams 536, 538 for curing the curable material carried on a second portion 522 of the associated product within the curing chamber.

In the embodiment illustrated, the plurality of mirrors or other reflectors 540, 542 are supported relative to a body of the curing chamber by a support member comprising first axial support member 570 attached on a proximal end thereof with the curing chamber body and carrying on a distal end thereof a pair of secondary oppositely directed axial support members 572, 574. Overall, in the example embodiment shown, the first axial support member 570 and the pair of secondary oppositely directed axial support members 572, 574 form a general "T" shape. The plurality of mirrors or other reflectors 540, 542 are carried in the free ands of the pair of secondary oppositely directed axial support members 572, 574. It is to be appreciated that one or more of the first axial support member 570 and the pair of secondary oppositely directed axial support members 572, 574 may be substantially rigid members and configured to locate and arrange and locate the mirrors or other reflectors relative to the areas that are inaccessible to direct illumination without the need for a redirection of the light beams. It is further to be appreciated that that one or more of the first axial support member 570 and the pair of secondary oppositely directed axial support members 572, 574 may be flexible members and configured to be manually manipulated into selected positions for locating and arranging the mirrors or other reflectors in the selected positions. In this embodiment, the flexible first axial support member 570 and the pair of secondary oppositely directed axial support members 572, 574 enable adaptation of the first axial support member to a range of associated roll formed products.

The first curing light source 510 includes, in the example illustrated, a plurality of curing light sources 550-557, wherein each of the plurality of curing light sources 550-557 generates a curing light beam 560-567, respectively, directed from each respective curing light source of the plurality of curing light sources to the first portion 520 of the associated product for curing the curable material carried on the first portion 520 of the associated product within the curing chamber.

In the example system 1 illustrated, the curing chamber 500 includes a plurality of positioning members 560, 562 configured to locate the associate part 20' relative to the curing chamber as the associated part is moved through the curing chamber along a processing axis L. in their preferred form, the plurality of positioning members 560, 562 comprise driven and/or un-driven product hold-down rolls. In addition and as illustrated, the plurality of curing light sources 550-557 are spaced apart circumferentially in a circle perpendicular to the processing axis L.

In accordance with the example method herein and as described above, the coating chamber 400 is arranged and configured to coat the associated product with the curable material prior to receiving the associated product into the input opening 502 of the curing chamber 500 by completely covering the entire outer surface of the associated part with the curable material. More particularly, the coating chamber 400 is configured to completely cover the entire outer surface of the associated part with an ultraviolet light curable coating material, such as, for example, RCT 01 1060 UV available from Rapid Cure Technologies, Inc.

It is to be appreciated then that the first curing light source 510 comprises a first ultraviolet light source directing a first ultraviolet light beam to the first portion of the associated product. In addition, in the example embodiment, the first reflective surface 530 comprises one or more mirrors 540, 542 configured to direct a second ultraviolet light beam to the second portion of the associated product. Preferably, the first curing light source 510 comprises plural UV light sources arranged in a circle surrounding the associated roll formed product so that the UV light generated by the light sources may be directed at the product to thereby cure the curable material accessible by direct illumination. In the example embodiment the plurality of curing light sources 550-557 are arranged in a pattern defining a virtual circle that is substantially perpendicular to the processing axis L. Also, preferably, the plurality of curing light sources 550-557 are substantially evenly spaced apart about the virtual circle.

In accordance with the example method herein and as described above, the cleaning chamber 300 is configured to clean the associated part, prior to completely covering the entire outer surface of the associated part with the ultraviolet light curable coating material, to remove contaminants that might adversely affect adhesion between the ultraviolet light curable coating material and the associated part. In the example embodiment the cleaning chamber includes a spray jet, a rinse, and a drier. The spray jet is configured to wash the surfaces of the moving length of roll formed product in a washing solution to remove surface contaminants that might interfere with the coating adhering to the roll formed product, the washing solution carrying away the contaminants removed from the roll formed product by the spray jet cleaning. The rinse is configured to rinse the surfaces of the moving length of roll formed product to remove the washing solution. The drier is configured to dry the surfaces of the moving length of roll formed product to remove the rinsing solution.

While the preferred example embodiments have been disclosed with respect to a roll formed product for use in the construction industry, it will be appreciated that the embodiments are easily adapted for use with any roll formed products or any other products or items having one or more edges and/or areas that are inaccessible to direct illumination without the need for a redirection of the light beams owing to shadow areas or the like that may manifest as the workpiece is formed before the coating thereon is cured.

Finally, it will be understood that the preferred embodiments have been disclosed by way of example, and that other modifications may occur to those skilled in the art without departing from the scope and spirit of the appended claims.

It is to be appreciated that each of the various features and teachings disclosed above may be utilized separately or in conjunction with other features and teachings to provide improved covering and curing of coverings on products, and to systems and methods for designing, manufacturing and using the same. Representative examples of the present invention, which examples utilize many of these additional features and teachings both separately and in combination, were described above in detail with reference to the attached drawings. This detailed description is merely intended to teach a person of skill in the art further details for practicing preferred aspects of the present teachings and is not intended to limit the scope of the invention. Therefore, combinations of features and steps disclosed in the detailed description may not be necessary to practice the invention in the broadest sense, and are instead taught merely to particularly describe representative examples of the present teachings.

Moreover, the various features of the representative examples and the dependent claims may be combined in ways that are not specifically and explicitly enumerated in order to provide additional useful embodiments of the present teachings. In addition, it is expressly noted that all features disclosed in the description and/or the claims are intended to be disclosed separately and independently from each other for the purpose of original disclosure, as well as for the purpose of restricting the claimed subject matter independent of the compositions of the features in the embodiments and/or the claims. It is also expressly noted that all value ranges or indications of groups of entities disclose every possible intermediate value or intermediate entity for the purpose of original disclosure, as well as for the purpose of restricting the claimed subject matter.

What is claimed is:

1. A system for processing an associated product having a central web portion having on a side thereof a bent region, the bent region comprising a flange portion and a return member, the flange portion extending from the central web portion and carrying the return member on an end thereof, the system comprising:

a curing chamber comprising an input opening and an exit opening, the curing chamber being configured to permit the associated product carrying a curable material to move therethrough by receiving the associated product into the input opening and passing the associated product from the curing chamber to the exit opening;

a first curing light source generating a first curing light beam directed from the first curing light source to a first portion of the associated product for curing a first portion of the curable material carried on a first side of the return member of the associated product within the curing chamber by directing a first curing light beam from a first curing light source to the first side of the return member of the associated product; and a first reflective surface directing a second curing light beam from the first reflective surface to a second portion of the associated product for curing a second portion of the curable material carried on a second side of the return member of the associated product opposite the first side of the return member of the associated product within the curing chamber by re-directing a second curing light beam from a first reflective surface to the second side of the return member of the associated product, the first reflective surface being located within a boundary of a physical extent of the associated product between the central web portion and the return member, wherein the return member creates a shadow of the first curing light beam on the second side of the return member and on the flange portion between the return member and the central web portion, wherein the second side of the return member is in the shadow of the first curing light beam directed from the first curing light source to the first side of the return member of the associated product, wherein the second side of the return member of the associated product is an area of the associated part inaccessible by direct illumination by the second curing light beam without the re-directing.

2. The system according to claim 1, wherein:

the first reflective surface comprises a plurality of mirrors receiving a composite second curing light beam and reflecting the composite second curing light beam from the plurality of mirrors as a plurality of second curing light beams for curing the curable material carried on a second portion of the associated product within the curing chamber.

3. The system according to claim 2, wherein:

the first curing light source comprises a plurality of curing light sources, each of the plurality of curing light sources generating a curing light beam directed from each respective curing light source of the plurality of curing light sources to the first portion of the associated product for curing the curable material carried on the first portion of the associated product within the curing chamber.

4. The system according to claim 3, further comprising:

a plurality of positioning members configured to locate the associate part relative to the curing chamber as the associated part is moved through the curing chamber along a processing axis L, wherein the plurality of curing light sources are spaced apart circumferentially in a circle perpendicular to the processing axis L.

5. The system according to claim 1, further comprising:

a coating chamber configured to coat the associated product with the curable material prior to receiving the associated product into the input opening of the curing chamber by covering the outer surface of the associated part with the curable material.

6. The system according to claim 5, wherein:

the coating chamber is configured to completely cover the entire outer surface of the associated part with an ultraviolet light curable coating material;

the first curing light source comprises a first ultraviolet light source directing a first ultraviolet light beam to the first portion of the associated product; and the first reflective surface comprises a mirror directing a second ultraviolet light beam to the second portion of the associated product.

7. The system according to claim 5, further comprising:

a cleaning chamber configured to clean the associated part, prior to covering the outer surface of the associated part with the ultraviolet light curable coating material, to remove contaminants that might adversely affect adhesion between the ultraviolet light curable coating material and the associated part.

8. The system according to claim 7, wherein the cleaning chamber comprises:

a spray jet configured to wash the surfaces of the moving length of roll formed product in a washing solution to remove surface contaminants that might interfere with the coating adhering to the roll formed product, the washing solution carrying away the contaminants removed from the roll formed product by the spray jet cleaning;

a rinse configured to rinse the surfaces of the moving length of roll formed product to remove the washing solution; and a drier configured to dry the surfaces of the moving length of roll formed product to remove the rinsing solution.

9. The system according to claim 1, further comprising, a support member comprising a first axial support member attached on a proximal end thereof with a body of the curing chamber and the first axial support member carrying on a distal end thereof a plurality of secondary oppositely directed axial support members, wherein the first reflective surface comprises a plurality of mirrors operatively coupled with the a plurality of secondary oppositely directed axial support members, the plurality of mirrors receiving a composite second curing light beam and reflecting the composite second curing light beam from the plurality of mirrors as a plurality of second curing light beams for curing the curable material carried on a second portion of the associated product within the curing chamber.

* * * * *